US005716293A

United States Patent [19]

Yabuki et al.

[11] Patent Number: 5,716,293

[45] Date of Patent: Feb. 10, 1998

[54] GOLF BALL

[75] Inventors: Yoshikazu Yabuki; Akira Kato; Yoshinori Sano, all of Shirakawa, Japan

[73] Assignee: Sumitomo Rubber Industries, Ltd., Hyogo-ken, Japan

[21] Appl. No.: 771,420

[22] Filed: Dec. 20, 1996

[30] Foreign Application Priority Data

Dec. 22, 1995 [JP] Japan ..... 7-350156

[51] Int. Cl.[6] ..... A63B 37/06; A63B 37/12

[52] U.S. Cl. ..... 473/363; 473/365; 473/378; 273/DIG. 22

[58] Field of Search ..... 473/357, 358, 473/359, 360, 361, 362, 363, 364, 378, 354, 365, 366; 273/DIG. 22

[56] References Cited

U.S. PATENT DOCUMENTS 5,222,739 6/1993 Horiuchi et al. ..... 473/372 X 5,244,969 9/1993 Yamada ..... 473/365 X

*Primary Examiner*—George J. Marlo

*Attorney, Agent, or Firm*—Birch, Stewart, Kolasch & Birch, LLP

[57] ABSTRACT

The present invention provides a golf ball which is superior in shot feel and controllability, and is superior in flight performance, durability and cut resistance and also have sufficient safety. The golf ball comprises a solid center, a thread rubber layer formed on the solid center and a cover formed on the thread rubber layer, wherein the solid center is composed of an inner spherical rubber formed of a vulcanized molded rubber composition containing an oily substance, and a coating layer of an oil-resistant substance for coating around the inner spherical rubber so as to prevent the bleeding of the oily substance of the inner spherical rubber, and the cover contains an ionomer resin as a main component and a cover composition constituting the cover has a stiffness modulus of from 70 to 280 MPs.

7 Claims, 1 Drawing Sheet

GOLF BALL

FIELD OF THE INVENTION

The present invention relates to a golf ball. More particularly, it relates to a golf ball which is good in shot feel and controllability which are inherent characteristics of a thread wound golf ball, and is good in flight performance, durability and cut resistance and also have sufficient safety.

BACKGROUND OF THE INVENTION

The thread wound golf ball is made by forming a solid center from rubber or a liquid center composed of a rubber bag containing liquid, followed by winding a thread rubber thereon to form a thread rubber layer; and then covering a cover (balata or ionomer) on the thread rubber layer.

The liquid center has large compression deformation and can impart less spin amount and large launch angle to a golf ball having the liquid center, in comparison with the golf ball having the solid center. The liquid center, however, has to be made by a complicated process and, if the golf ball is cut with a cutter, the inside liquid is sprayed out. If the liquid is come into eyes, one would possibly lose one's sight.

The solid center does not have any difficult in production and does not show any danger when cut by a cutter. However, as mentioned above, the solid center does not provide with sufficient flight performance in flight distance and the like.

In Japanese Kokai Publication Hei7 (1995)-39607, the present inventors proposed a thread wound golf ball wherein the solid center contains oily substance and makes it softer to approach to the liquid center. The solid center is also covered with a coating layer, in order to prevent the breeding of the oily substance. The Japanese Publication suggests the use of an ionomer resin as the cover, but does not suggest any physical properties of the cover.

OBJECTS OF THE INVENTION

It has been found by the present inventors that the cover should have specific physical properties, in order to make much use of the performance of the solid center containing oily substance. The object of the present invention is to provide a golf ball which is good in shot feel and controllability which are inherent characteristics of a thread wound golf ball, and is good in flight performance, durability and cut resistance and also have sufficient safety.

This object as well as other objects and advantages of the present invention will become apparent to those skilled in the art from the following description with reference to the accompanying drawing.

SUMMARY OF THE INVENTION

Figure 1:
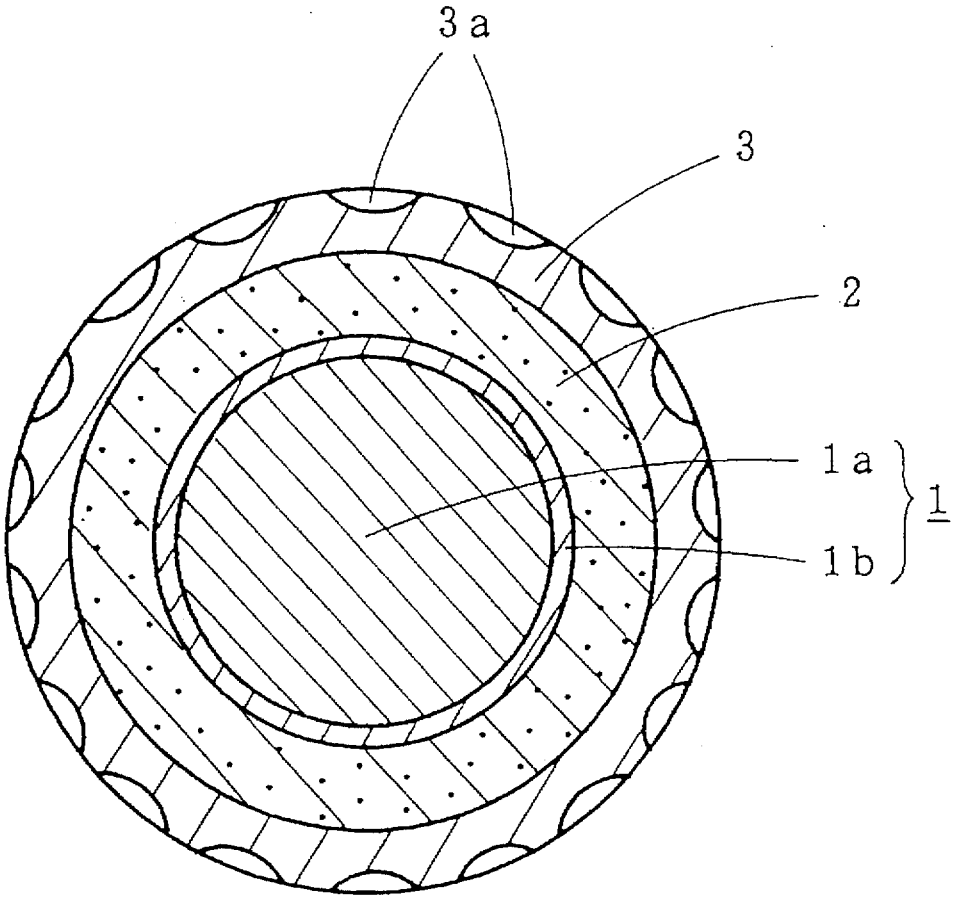
FIG. 1 is a schematic cross section illustrating one embodiment of the golf ball of the present invention.

The present invention provides a golf ball which comprises a solid center, a thread rubber layer formed on the solid center and a cover formed on the thread rubber layer, wherein the solid center is composed of an inner spherical rubber formed of a vulcanized molded article of a rubber composition containing an oily substance, and a coating layer of an oil-resistant substance for coating around the inner spherical rubber so as to prevent the bleeding of the oily substance of the inner spherical rubber, and the cover contains an ionomer resin as a main component and a cover composition constituting the cover has a stiffness modulus of from 70 to 280 MPs.

DETAILED DESCRIPTION OF THE INVENTION

In the present invention, the base rubber of the rubber composition for forming the inner spherical rubber of the solid center may be any one, capable of performing sulfur vulcanization or peroxide vulcanization. For example, polybutadiene rubber (BR), natural rubber (NR), ethylene-propylene-diene rubber (EPDM), polynorbornene rubber and the like can be suitably used. It is also possible to use styrene, ethylene and urethane thermoplastic rubbers. It is preferred that the rubbers are compatible with the oily substance and can contain the oily substance as much as possible, and has a suitable rebound when the vulcanization molding was performed in the state where the oily substance is uniformly dispersed in the rubber.

The oily substance is not specifically limited, and various substances can be used. Preferably, the oily substance has fluidity or a semi-solid form at room temperature and has little volatility. Particularly preferred is the oily substance which is good in compatibility with the base rubber and causes no drastic deterioration of the rebound of the base rubber after being uniformly dispersed in the base rubber, or which can impart a suitable rebound to a base rubber having low rebound by mixing with the base rubber. Examples of the oily substance are the followings.

(1) Petroleum oil:

It is often used as an extensive oil of the rubber and is classified as follows according to a content of aromatic ring, naphthene ring and paraffin chain:

(i) paraffin oil containing not less than 50% of a paraffin chain;

(ii) naphthene oil containing 30–45% of a naphthene ring; and (iii) aromatic oil containing not less than 35% of an aromatic carbon.

(2) Plasticizer:

For example, phthalate plasticizers such as dibutyl phthalate (DBP), dioctyl phthalate (DOP), etc.; adipate plasticizers such as dioctyl adipate, etc.; sebacate plasticizers such as dioctyl sebacate (DOS), etc.; phosphate plasticizers such as tricresyl phosphate (TCP), etc.; and adipic polyester.

(3) Rubber substitute (factice):

It is obtained by vulcanizing vegetable oils with sulfur or sulfur chloride and examples thereof are candy rubber substitute, black rubber substitute, brown rubber substitute and the like.

(4) Alkylbenzene:

For example, 1-dodecyl-4-hexylbenzene, 1-dodecyl-3-hexylbenzene, 1, 3, 5-methylene, 1, 2, 3-hemimellitene and the like.

(5) Liquid rubber:

For example, liquid polybutadiene, liquid polyisoprene and the like. These oily substances may be used alone or in combination thereof.

It is preferred to decide the combination of the oily substance and the base rubber, taking the compatibility of the oily substance to the base rubber into consideration. Typical examples of the preferred combination are polybutadiene or natural rubber and naphthene oil or aromatic oil; ethylene-propylene-diene rubber and paraffin oil; polynorbornene rubber and naphthene oil, aromatic oil, plasticizer, alkylbenzene or paraffin oil; and urethane and plasticizer or rubber substitute.

An amount of the oily substance is preferably from about 30 to 500 parts by weight, particularly from 50 to 400 parts by weight, based on 100 parts by weight of the base rubber. When the amount of the oily substance is smaller than 30 parts by weight, based on 100 parts by weight of the base rubber, it is impossible to obtain a sufficient effect of inhibiting an increase in spin. On the other hand, when the amount of the oily substance is larger than 500 parts by weight, based on 100 parts by weight of the base rubber, it is often difficult to sufficiently mix the oily substance with the base rubber according to the combination of the oily substance and base rubber.

In the present invention, fillers as a specific gravity adjustor (e.g. barium sulfate, etc.), reinforcers (e.g. hydrous silicic acid, carbon black. etc.), processing aids as a tackifier, antioxidants, etc. can be contained in the rubber composition used for forming the inner spherical rubber, in addition to the above base rubber and oily substance. When the sulfur vulcanization is performed to form a vulcanized molded article, zinc oxide, stearic acid, vulcanization accelerator, zinc stearate, etc. may be added as a vulcanization chemical. When the peroxide vulcanization (crosslinking) is performed to form a vulcanized molded article, organic peroxide (e.g. dicumyl peroxide, 1,1-di-t-butylperoxy-3,3,5-trimethylcyclohexane, etc.), activator (e.g. zinc stearate, etc.), zinc oxide, crosslinking agent (e.g. zinc acrylate, zinc methacrylate, N,N'-m-phenylendimaleimide, etc.), etc. may be added in a suitable amount.

In the present invention, the solid center is made by covering around the inner spherical rubber containing the above oily substance with the coating layer of the oil-resistant substance. The oil-resistant substance constituting the coating layer may be any one which can prevent the bleeding of the oily substance contained in the inner spherical rubber. An oil-resistant substance having a flexibility is generally used and, specifically, a thermoplastic resin and an oil-resistant rubber are used as the main material.

Typical examples of the thermoplastic resin or oil-resistant rubber used as the main material of the oil-resistant substance are ionomer resin, acrylonitrile-butadiene rubber (NBR), chloroprene rubber (CR), urethane rubber, fluorosilicone rubber and the like. There are preferred because the covering can be performed without deteriorating the physical properties of the inner spherical rubber. A thickness of the coating layer of this oil-resistant substance is not specifically limited, but is preferably from 0.01 to 5 mm, particularly from 0.1 to 2 mm.

When the coating layer of the oil-resistant substance is formed from the oil-resistant rubber, a rubber composition for forming the coating layer is prepared. When the rubber composition is prepared, fillers, reinforcers, processing aids, antioxidants, sulfur, zinc oxide, stearic acid and vulcanization chemicals (e.g. vulcanization accelerator, etc.) are appropriately formulated to the oil-resistant rubber similar to the preparation of the rubber composition for inner spherical rubber, and then vulcanization is performed in a molding step at the time of forming the coating layer.

In the present invention, the solid center is made by charging the rubber composition for inner nuclear rubber in a mold, followed by compression molding, or injection molding to form an inner spherical rubber and then covering the coating layer of the oil-resistant substance around the inner spherical rubber.

When the coating layer is formed from the oil-resistant substance, for example, there can be used a method of previously molding the oil-resistant substance into a half-shell, covering the inner spherical rubber with a pair of half-shells, followed by compression molding in a mold, or a method of injection-molding the oil-resistant substance directly on the inner spherical rubber to cover it.

Examples of the other coating methods are a method comprising winding a thread rubber of an oil-resistant rubber (e.g. acrylonitrile-butadiene rubber, chloroprene rubber, urethane rubber, fluorosilicone rubber, etc.) around the inner spherical rubber, or a method comprising winding the thread rubber around the inner spherical rubber, dipping the resultant in a latex of the oil-resistant rubber and vulcanizing the latex.

In the present invention, when the solid center has not a suitable rebound, the initial velocity of the golf ball at the time of hitting is low and it is impossible to attain a long flight distance. Therefore, when the rebound of the solid center is expressed by the height of rebound obtained by dropping the solid center on a rigid face such as concrete block from the height of 254 cm (100 inches) at 23° C., the height of rebound is preferably not less than 70 cm. When the rebound of the solid center is lower than 70 cm, the initial velocity of the golf ball is too low and, it is difficult to sufficiently develop an effect of the solid center of the present invention.

Regarding the solid center of the present invention, an amount of deformation formed by applying loading of 500 g is preferably not less than 0.5 mm, preferably from 1 to 5 mm. When the amount of deformation formed by applying loading of 500 g is smaller than the above range, it shows that the solid center is hard. Therefore, the spin amount at the time of hitting is larger and the shot feel is poor.

In the present invention, an outer diameter of the solid center is preferably from 23 to 36 mm, particularly from 26 to 34 mm. When the outer diameter of the solid center is smaller than 23 mm, the spin amount is large and the launch angle is small, which results in the decrease of flight distance. On the other hand, when the outer diameter of the solid center is larger than 36 mm, the thread rubber layer is thin and it is difficult to obtain the predetermined hardness of the golf ball. Therefore, the flight distance may reduce and shot feel is poor.

The thread rubber layer is formed by winding the thread rubber around the solid center in the stretched state, and a so-called thread wound core is formed by the solid center and thread wound layer.

The thread rubber for forming the thread rubber layer can be the same one which has hitherto been used. For example, it can be obtained by vulcanizing a rubber composition in which an antioxidant, a vulcanization accelerator, sulfur, etc. are formulated in a natural rubber or a mixture of the natural rubber and a synthetic polyisoprene.

In the present invention, the resin component of the cover can be an ionomer resin. Examples of the ionomer resins are ionomer resin obtained by neutralizing at least a portion of carboxyl groups in a copolymer of ethylene and acrylic acid or methacrylic acid with a metal ion, ionomer resin obtained by neutralizing at least a portion of carboxyl groups in a terpolymer of ethylene, acrylic acid or methacrylic acid and an α,β-unsaturated carboxylate with a metal ion and the like.

Regarding the composition ratio of the copolymerization component in the ionomer resins, when a base polymer of the ionomer resin is a copolymer of an α-olefin and an α,β-unsaturated carboxylic acid having 3 to 8 carbon atoms, an amount of the α-olefin is preferably from 70 to 90% by weight and that of the α,β-unsaturated carboxylic acid having 3 to 8 carbon atoms is preferably from 10 to 30% by weight. When the base polymer is a terpolymer of an α-olefin, an α,β-unsaturated carboxylic acid having 3 to 8 carbon atoms and an α,β-unsaturated carboxylate having 2 to 22 carbon atoms, the amount of the α-olefin is preferably from 70 to 85% by weight, that of the α,β-unsaturated carboxylic acid having 3 to 8 carbon atoms is preferably from 5 to 20% by weight and that of the α,β-unsaturated carboxylate having 2 to 22 carbon atoms is preferably from 10 to 25% by weight.

The α-olefin can be ethylene, propylene, 1-butene, 1-pentene and the like. Among them, ethylene is particularly preferred. The α,β-unsaturated carboxylic acid having 3 to 8 carbon atoms can be acrylic acid, methacrylic acid, fumaric acid, maleic acid, crotonic acid and the like. Among them, acrylic acid and methacrylic acid are particularly preferred. The α,β-unsaturated carboxylate having 2 to 22 carbon atoms can be methyl, ethyl, propyl, n-butyl, isobutyl ester and the like of acrylic acid, methacrylic acid, fumaric acid, maleic acid, and the like. Among them, acrylate and methacrylate are particularly preferred.

Examples of the metal ion for neutralizing at least a portion of carboxyl groups in the above copolymer of the α-olefin and α,β-unsaturated carboxylic acid having 3 to 8 carbon atoms or terpolymer of the α-olefin, α,β-unsaturated carboxylic acid having 3 to 8 carbon atoms and α,β-unsaturated carboxylate having 2 to 22 carbon atoms are sodium ion, lithium ion, zinc ion, magnesium ion, potassium ion and the like.

The ionomer resins are generally shown by the trade name. Examples of the ionomer resins commercially available from Mitsui Du Pont Polychemical Co., Ltd. are ionomer resins such as Hi-milan 1605, (Na), Hi-milan 1707 (Na), Hi-milan AM7318 (Na), Hi-milan 1706 (Zn), Hi-milan AM7315 (Zn), Hi-milan AM7317 (Zn), Hi-milan AM7311 (Mg), Hi-milan MK7320 (K), etc.; terpolymer ionomer resins such as Hi-milan 1856 (Na), Hi-milan 1855 (Zn), Hi-milan AM7316 (Zn), etc. Examples of them commercially available from Du Pont Co. are ionomer resins such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li), etc.; terpolymer ionomer resins such as Surlyn AD8265 (Na), Surlyn AD8269 (Na), etc. Examples of those commercially available from Exxon chemical Co. include ionomer resins such as Iotek 7010 (Zn), Iotek 8000 (Na), etc. Further, Na, Zn, K, Li, Mg, etc., which are described in parentheses at the back of the trade name of the above ionomer resin show neutralization metal ion species, respectively. In the present invention, as the ionomer resin, a mixture of two or more kinds of the ionomer resin neutralized with the monovalent metal ion and that neutralized with the divalent metal ion may be used.

In the present invention, the resin component of the cover may be composed of only an ionomer resin, but may be a heated mixture of an ionomer resin and a glycidyl group-modified thermoplastic elastomer, a heated mixture of an ionomer resin, a maleic anhydride-modified thermoplastic elastomer and a glycidyl group-modified thermoplastic elastomer, a heated mixture of an ionomer resin and a terpolymer of ethylene, an unsaturated carboxylate and an unsaturated carboxylic acid and the like.

Examples of the above glycidyl group-modified thermoplastic elastomer include ethylene-glycidyl methacrylate copolymer, ethylene-glycidyl methacrylate-methyl acrylate terpolymer and ethylene-glycidyl methacrylate-vinyl acetate terpolymer, which are commercially available from Sumitomo Chemical Industries Co., Ltd. under the trade name of "Bondfast"; glycidyl methacrylate adducts of hydrogenated styrene-butadiene-styrene block copolymers, which are commercially available from Asahi Kasei Industries Co., Ltd. under the trade name of "Taftek Z514" and "Taftek Z513"; and ethylene-acrylate-glycidyl methacrylate terpolymer, which is commercially available from Du Pont USA under the trade name of "Elvaloy-A5".

Examples of the maleic anhydride-modified thermoplastic elastomer include maleic anhydride adducts of hydrogenated styrene-butadiene-styrene block copolymers, which are commercially available from Asahi Kasei Industries Co., Ltd. under the trade name of "Taftek M series"; ethylene-ethyl acrylate-maleic anhydride terpolymers, which are commercially available from Sumitomo Chemical Industries Co., Ltd. under the trade name of "Bondine"; and products obtained by graft-modifying ethylene-ethyl acrylate copolymers with maleic anhydride, which are commercially available from Mitsui Du Pont Polychemical Co., Ltd. under the trade name of "AR series", and these include products of various grades.

Examples of the terpolymer of the ethylene, unsaturated carboxylate and unsaturated carboxylic acid include ethylene-isobutyl acrylate-methacrylate terpolymers, which are commercially available from Mitsui Du Pont Polychemical Co., Ltd. under the trade name of "Neucrel AN4212C", "Neucrel N0805J" and the like.

It is preferred that the above glycidyl group-modified thermoplastic elastomer, maleic anhydride-modified elastomer and terpolymer of the ethylene, unsaturated carboxylate and unsaturated carboxylic acid have a JIS-A hardness of 30–90 or a Shore D-scale hardness of 5–45 in order that they are respectively mixed with the ionomer resin and a stiffness modulus of the cover composition containing the resultant mixture as the main component is adjusted within the range from 70 to 280 MPa.

In the present invention, when using the heated mixture of the ionomer resin and glycidyl group-modified thermoplastic elastomer as the resin component of the cover, a glycidyl group in the glycidyl group-modified thermoplastic elastomer reacts with a free carboxyl group in the ionomer resin by mixing both components to form a soft block copolymer or a graft copolymer on the interface. Then, these copolymers are uniformly dispersed in a matrix of the ionomer resin due to a shear force at the time of kneading and the ionomer resin is softened. Therefore, deterioration of excellent flight performance (rebound characteristics) and cut resistance of the ionomer resin is inhibited, thereby making it possible to obtain a golf ball which is superior in feeling and controllability and is also superior in flight performance and cut resistance.

On the other hand, when using the heated mixture of the ionomer resin, maleic anhydride-modified thermoplastic resin and glycidyl group-modified thermoplastic elastomer as the resin component of the cover, a glycidyl group in the glycidyl group-modified thermoplastic elastomer reacts with a free carboxyl group in the ionomer resin and maleic anhydride in the maleic anhydride-modified thermoplastic elastomer. Then, similar to the above, soft components of the glycidyl group-modified thermoplastic elastomer and maleic anhydride are uniformly dispersed in a matrix of the ionomer resin and the ionomer resin is softened. Therefore, deterioration of excellent flight performance (rebound characteristics) and cut resistance of the ionomer resin is inhibited, thereby making it possible to obtain a golf ball which is superior in feeling and controllability and is also superior in flight performance and cut resistance.

When using a heated mixture of the ionomer resin and terpolymer of the ethylene, unsaturated carboxylate and unsaturated carboxylic acid, a part of the unsaturated carboxylic acid in the terpolymer is ionized and the ionomer resin is softened according to the same manner as that described above, thereby making it possible to obtain a golf ball which is superior in feeling and controllability and is also superior in flight performance and cut resistance.

As described above, in order to adjust the stiffness modulus of the cover composition within the range from 70 to 280 MPa by mixing other resin with the ionomer resin, a weight ratio of the ionomer resin to the other resin (i.e. glycidyl group-modified thermoplastic elastomer, maleic anhydride-modified thermoplastic elastomer, three-dimensional polymer of the ethylene, unsaturated carboxylate and unsaturated carboxylic acid) is preferably from 95:5 to 55:45.

In the present invention, various additives such as pigments (e.g. titanium dioxide, barium sulfate, etc.), dispersants, antioxidants, UV absorbers, photostabilizers, etc. can be optionally formulated in the resin component in the preparation of the cover composition.

In the present invention, the stiffness modulus of the cover composition is specified within the range from 70 to 280 MPa. When the stiffness modulus of the cover composition is lower than 70 MPa, the cover is too soft and the spin amount is too large. Therefore, the flight distance is reduced and the cut resistance is degraded On the other hand, when the stiffness modulus of the cover composition is higher than 280 MPa, it is difficult to obtain a suitable backspin amount and, therefore, the controllability is poor and the shot also is poor.

In the present invention, the stiffness modulus of the cover composition constituting the cover is used in place of the stiffness modulus of the cover. Once the golf ball is produced, the stiffness modulus of the cover of the golf ball can not be measured by a current technique and, therefore, the measurement of the stiffness modulus must be performed after producing a sample from the cover composition. Although the stiffness modulus of the cover of the golf ball can not be performed, the stiffness modulus of the cover and that of the cover composition are considered to be substantially the same. The cover composition contains a resin component as a main component and a small amount of additives such as pigment is merely added in addition to the resin component. Therefore, it is considered that the flexural of the cover composition and that of the resin component are substantially the same. In the present invention, the stiffness modulus is measured according to ASTM D-747 after a sheet having a thickness of about 2 mm obtained from the cover composition due to hot-press molding is preserved at 23° C. for two weeks.

In the present invention, the hardness of the cover composition is preferably from 40 to 60 in Shore D-scale hardness. When the hardness of the cover composition is lower than 40 in Shore D-scale hardness, the cover is too soft and the spin amount is too large. Therefore, the flight distance reduces and the cut resistance is degraded. On the other hand, when the hardness of the cover composition is higher than 60 in Shore D-scale hardness, it is difficult to obtain a suitable backspin amount and, therefore, the controllability is poor and the shot feel also is poor. The hardness of the cover was measured according to ASTM D2240 after a sheet having a thickness of about 2 mm obtained from the cover composition due to hot-press molding is preserved at 23° C. for two weeks and three sheets were laminated each other.

A method of covering the cover on the core (thread wound core of the solid center and thread rubber layer) is not specifically limited, but may be a conventional method. For example, it can be a method comprising previously molding a cover composition into a semi-spherical half-shell, covering a core with two half-shells, followed by pressure molding at 130° to 170° C. for 5 to 15 minutes, or a method comprising injection-molding the cover composition directly on the core to cover the core. The thickness of the cover is normally about from 1 to 4 mm. At the time of cover molding, dimples may be optionally formed on the surface of the golf ball. In addition, a paint or stamping may be optionally provided after cover molding.

The structure of the golf ball of the present invention will be explained with reference to the accompanying drawing. FIG. 1 is a schematic cross section illustrating one embodiment of the golf ball of the present invention. In FIG. 1, 1 is a solid center comprising an inner spherical rubber 1*a* and a coating layer 1*b* for coating around the inner spherical rubber. The inner spherical rubber 1*a* is composed of a vulcanized molded article of the rubber composition containing the oily substance. The coating layer 1*b* is formed of an oil-resistant substance and serves to prevent bleeding of the oily substance of the inner spherical rubber 1*a*.

2 is a thread rubber layer and this thread rubber layer 2 is formed by winding a thread rubber around the solid center 1 in the stretched state, and a core referred to as a "thread wound core" is formed by the solid center 1*a* and this thread rubber layer 2. 3 is a cover for coating the core. As the resin component of this cover 3, an ionomer resin is used as a main component and a stiffness modulus of the cover composition is adjusted within the range from 70 to 280 MPa. 3*a* indicates dimples provided on the cover 3.

A suitable number/embodiment of the dimples 3*a* are optionally provided on the cover 3 so that desired characteristics may be obtained. In addition, painting or marking is optionally provided on the surface of the golf ball.

As described above, the present invention could provide a golf ball which is superior in feeling and controllability, and is also superior in flight performance, durability and cut resistance. When the golf ball is hit by a driver, the solid center containing oily substance can provide with excellent trajectory, similar to the golf ball having the liquid center. When it is used at approach shot, the characteristics of the cover significantly affect on the properties of the golf ball and the soft cover provides with each stop on a green.

EXAMPLES

The following Examples and Comparative Examples further illustrate the present invention in detail but are not to be construed to limit the scope thereof.

Examples 1 to 8 and Comparative Examples 1 to 5

The golf balls of Examples 1 to 8 and Comparative Examples 1 to 5 were produced through the following steps (1) to (3).

(1) Production of core

Centers A, B, C, D and E were made according to formulations shown in Table 1 and Table 2. The centers A and B belong to the solid center of the present invention. Solid centers having an outer diameter of 30.2 mm were respectively made by charging the rubber compositions for inner spherical rubber of formulations in the column of the center A and B shown in Table 1 into a mold, subjecting them to compression molding and vulcanization at 155° C. for 20 minutes to make inner spherical rubbers having a diameter of 28.2 mm, covering the inner spherical rubbers with the rubber compositions for coating layer of formulations in the column of the center A and B shown in Table 2 in a thickness of 1 mm, putting the coated inner spherical rubbers in a mold, and subjecting them to compression molding and vulcanization at 155° C. for 15 minutes. These centers A and B will be explained with reference to FIG. 1. That is, a solid center 1 having an outer diameter of 30.2 mm is formed by coating around the inner spherical rubber 1*a* having a diameter of 28.2 mm with a coating layer 1*b* of an oil-resistant substance having a thickness of 1 mm.

The center C was a solid center which is not within the scope of the present invention, and was made by charging a rubber composition for inner spherical rubber of a formulation in the column of the center C shown in Table 1 into a mold, and subjecting it to compression molding and vulcanization at 155° C. for 20 minutes. This center C had an outer diameter of 30.0 mm and contains no oily substance [Sunsen 255 ZJ (trade name)], and is not provided with a coating layer. That is, this center C corresponds to a solid center which has hitherto been used.

The center D was a solid center which is not within the scope of the present invention, and was made by charging a rubber composition for inner spherical rubber of a formulation in the column of the center D shown in Table 1 into a mold, and subjecting it to compression molding and vulcanization at 155° C. for 20 minutes. This center D had an outer diameter of 30.0 mm and is not provided with a coating layer like center A.

The center E corresponds to a liquid center which has hitherto been used, and is composed of a paste prepared by dispersing barium sulfate in water and a cover rubber for coating the paste, the cover rubber being composed of a vulcanized natural rubber having a thickness of 1.7 mm. The center D has an outer diameter of 28.1 mm.

An amount of each component shown in the tables is represented by parts by weight, and it is also the same in the following tables. The details of components represented by the trade name in the tables are shown at the back of Table 2.

Physical properties of the resulting centers are shown in Table 2. The measuring methods of the compression deformation and rebound are as followings.

Compression deformation:

An amount of deformation formed by applying a load of 500 g to a center is measured using a handy compression testing machine (manufactured by Kato Tec. Co.). A compression rate at the time of loading is 0.2 mm/second.

Rebound:

A center is dropped on a concrete plate from a height of 254 cm and a height of rebound is measured at 23° C.

TABLE 1

| | | Center | | | | |
|---|---|---|---|---|---|---|
| | | A | B | C | D | E |
| Rubber composition for inner spherical rubber | | | | | | |
| Norsolex | ※1 | 100 | 100 | 0 | 100 | Liquid center |
| Sunsen 255 ZJ | ※2 | 200 | 300 | 0 | 200 | |
| JSR BR11 | ※3 | 0 | 0 | 100 | 0 | |
| Sulfur | | 2 | 2 | 10 | 2 | |
| Zinc oxide | | 5 | 5 | 5 | 5 | |
| Stearic acid | | 2 | 2 | 2 | 2 | |
| Barium sulfate | | 280 | 380 | 75 | 240 | |
| Nocceler CZ | ※4 | 0 | 0 | 1.5 | 0 | |
| Nocceler TT | ※5 | 0.8 | 0.8 | 0.2 | 0.8 | |
| Nocceler M | ※6 | 0.8 | 0.8 | 0 | 0.8 | |
| Nocceler TBT-N | ※7 | 1.2 | 1.2 | 0 | 1.2 | |
| Suncelar TE-G | ※8 | 0.4 | 0.4 | 0 | 0.4 | |

TABLE 2

| | | Center | | | | |
|---|---|---|---|---|---|---|
| | | A | B | C | D | E |
| Rubber composition for coating layer | | | | | | |
| JSR N230S | ※9 | 100 | 100 | — | — | — |
| Zinc oxide | | 5 | 5 | — | — | — |
| Stearic acid | | 1.5 | 1.5 | — | — | — |
| FEF Black | | 20 | 20 | — | — | — |
| FT Black | | 30 | 30 | — | — | — |
| DOP | | 10 | 10 | — | — | — |
| Nocrac ODA | ※10 | 1.5 | 1.5 | — | — | — |
| Nocceler CZ | | 1.5 | 1.5 | — | — | — |
| Sulfur | | 0.3 | 0.3 | — | — | — |
| Physical properties of center | | | | | | |
| Diameter of inner spherical rubber (mm) | | 28.2 | 28.2 | — | — | — |
| Outer diameter of center (mm) | | 30.2 | 30.2 | 30.0 | 30.0 | 28.1 |
| Weight (g) | | 20.4 | 20.4 | 20.5 | 20.5 | 17.0 |
| Compression deformation (mm) | | 1.7 | 3.0 | 0.4 | 1.5 | — |
| Rebound (cm) | | 95 | 90 | 215 | 125 | — |

※1: Norsolex (trade name)
Polynorbornene rubber manufactured by Nippon Zeon Co., Ltd.
※2: Sunsen 255ZJ (trade name)
Naphthene oil manufactured by Nihon Sun Sekiyu Co., Ltd.
※3: JSR BR11 (trade name)
Polybutadiene rubber manufactured by Japan Synthetic Rubber Co., Ltd.
※4: Nocceler CZ (trade name)
Vulcanization accelerator manufactured by Ohuchi Shinko Kagaku Kogyo Co., Ltd., N-cyclohexyl-2-benzothiazyl sulfenamide
※5: Nocceler TT (trade name)
Vulcanization accelerator manufactured by Ohuchi Shinko Kagaku Kogyo Co., Ltd., Tetramethylthiuram disulfide
※6: Nocceler M (trade name)
Vulcanization accelerator manufactured by Ohuchi Shinko Kagaku Kogyo Co., Ltd., 2-Mercaptobenzothiazole
※7: Nocceler TBT-N (trade name)
Vulcanization accelerator manufactured by Ohuchi Shinko Kagaku Kogyo Co., Ltd., Tetrabutylthiuram disulfide
※8: Sunceler TE-G (trade name)
Vulcanization accelerator manufactured by Sanshin Kagaku Kogyo Co., Ltd., Diethyl tellurium dithiocarbamate
※9: JSR N2305 (trade name)
Acrylonitrile-butadiene rubber manufactured by Japan Synthetic Rubber Co., Ltd.
※10: Nocrac ODA (trade name)
Antioxidant manufactured by Ohuchi Shinko Kagaku Kogyo Co., Ltd., Alkylated diphenylamine Then, a thread rubber layer was formed by winding a thread rubber made of a blend rubber whose base rubber is a mixture of a natural rubber and a low-cis isoprene rubber in the weight ratio of 50:50 [Shell IR-309 (trade name), manufactured by Shell Chemistry Co.] in the stretched state around the center to make a thread wound core having an outer diameter of 39.5 mm.

(2) Preparation of cover composition

Formulation materials of the formulations shown in Tables 3 to 5 were mixed using a kneading type twin-screw extruder to obtain a pelletized cover composition, respectively. The formulations of the compositions for cover of Examples 1 to 4, those of Examples 5 to 8 and those of Comparative Examples 1 to 5 are shown in Table 3, Table 4 and Table 5, respectively. The amount of each component shown in the tables is represented by parts by weight, similar to the above.

The extrusion conditions are as follows: a screw diameter: 45 mm; a screw revolution per minute: 200 rpm; a screw L/D: 35. The formulation components were heated at 220°–260° C. at the die position of the extruder. The stiffness modulus of the resulting cover composition was measured. The results are shown in Tables 3 to 5. The stiffness modulus was measured according to ASTM D-747 after a sheet having a thickness of about 2 mm obtained from each cover composition due to hot-press molding was preserved at 23° C. for two weeks. The hardness of the cover was measured according to ASTM D2240 after a sheet having a thickness of about 2 mm obtained from each cover composition due to hot-press molding was preserved at 23° C. for two weeks and three sheets were laminated each other. The kind of the center used in the production of the golf ball is represented by the symbols A, B, C, D and E in Tables 3 to 5.

Among the compositions for cover used for the cover of the golf balls of the Comparative Examples, the compositions for cover, which are particularly used as a criterion for comparison, will be explained. The cover composition of Comparative Example 1 is a cover composition using only a high-rigid ionomer resin as the resin component, and it corresponds to a composition for conventional standard ionomer resin cover. The cover composition of Comparative Example 5 is a composition for standard balata cover.

TABLE 3

| | | Example No. | | | |
|---|---|---|---|---|---|
| Center | | 1 A | 2 A | 3 A | 4 A |
| Cover composition | | | | | |
| Hi-milan 1605 | ·X·11 | 20 | 25 | 0 | 0 |
| Hi-milan 1706 | ·X·12 | 0 | 0 | 0 | 0 |
| Hi-milan 1557 | ·X·13 | 5 | 25 | 0 | 0 |
| Hi-milan 1855 | ·X·14 | 75 | 50 | 25 | 36 |
| Surlyn AD 8511 | ·X·15 | 0 | 0 | 25 | 24 |
| Surlyn AD 8512 | ·X·16 | 0 | 0 | 25 | 24 |
| TAFTEC Z 514 | ·X·17 | 0 | 0 | 25 | 8 |
| AR-201 | ·X·18 | 0 | 0 | 0 | 8 |
| Titanium dioxide | | 2 | 2 | 2 | 2 |
| Barium sulfate | | 2 | 2 | 2 | 2 |
| Stiffness modulus (MPa) | | 150 | 220 | 170 | 170 |
| Hardness (Shore D-scale hardness) | | 56 | 58 | 51 | 53 |

TABLE 4

| | | Example No. | | | |
|---|---|---|---|---|---|
| Center | | 5 B | 6 B | 7 B | 8 B |
| Cover composition | | | | | |
| Hi-milan 1605 | | 0 | 0 | 20 | 0 |
| Hi-milan 1706 | | 0 | 0 | 20 | 0 |
| Hi-milan 1855 | | 0 | 30 | 30 | 20 |
| Surlyn AD 8511 | | 30 | 25 | 0 | 25 |
| Surlyn AD 8512 | | 30 | 25 | 0 | 25 |
| TAFTEC Z 514 | | 25 | 20 | 0 | 0 |
| AR-201 | | 15 | 0 | 0 | 0 |

TABLE 4-continued

| | | Example No. | | | |
|---|---|---|---|---|---|
| Center | | 5 B | 6 B | 7 B | 8 B |
| Neucrel AN 4212 C | ·X·19 | 0 | 0 | 30 | 0 |
| Bondine AX 8390 | ·X·20 | 0 | 0 | 0 | 30 |
| Titanium dioxide | | 2 | 2 | 2 | 2 |
| Barium sulfate | | 2 | 2 | 2 | 2 |
| Stiffness modulus (MPa) | | 130 | 185 | 150 | 150 |
| Hardness (Shore D-scale hardness) | | 47 | 55 | 54 | 52 |

TABLE 5

| | | Comparative Example No. | | | | |
|---|---|---|---|---|---|---|
| Center | | 1 C | 2 D | 3 A | 4 A | 5 E |
| Cover composition | | | | | | |
| Hi-milan 1605 | | 50 | 20 | 0 | 50 | Balata cover |
| Hi-milan 1706 | | 50 | 0 | 0 | 50 | |
| Hi-milan 1557 | | 0 | 5 | 0 | 0 | |
| Hi-milan 1855 | | 0 | 75 | 15 | 0 | |
| Hi-milan AM 7316 | ·X·21 | 0 | 0 | 85 | 0 | |
| Titanium dioxide | | 2 | 2 | 2 | 2 | |
| Barium sulfate | | 2 | 2 | 2 | 2 | |
| Stiffness modulus (MPa) | | 340 | 150 | 34 | 340 | |
| Hardness (Shore D-scale hardness) | | 63 | 56 | 37 | 63 | |

·X·11: Hi-milan 1605 (trade name)

Ethylene-methacrylic acid copolymer ionomer resin obtained by neutralizing with a sodium ion, manufactured by Mitsui Du Pont Polychemical Co., Ltd., MI (melt index): 2.8, stiffness modulus: 310 MPa ·X·12: Hi-milan 1706 (trade name)

Ethylene-methacrylic acid copolymer ionomer resin obtained by neutralizing with a zinc ion, manufactured by Mitsui Du Pont Polychemical Co., Ltd., MI: 0.8, stiffness modulus: about 260 MPa ·X·13: Hi-milan 1557 (trade name)

Ethylene-methacrylic acid copolymer ionomer resin obtained by neutralizing with a zinc ion, manufactured by Mitsui Du Pont Polychemical Co., Ltd., MI: 5.0, stiffness modulus: about 230 MPa ·X·14: Hi-milan 1855 (trade name)

Ethylene-butyl acrylate-methacrylic acid terpolymer ionomer resin obtained by neutralizing with a zinc ion, manufactured by Mitsui Du Pont Polychemical Co., Ltd., MI 1.0, stiffness modulus: about 90 MPa ·X·15: Surlyn AD8511 (trade name)

Ethylene-methacrylic acid copolymer ionomer resin obtained by neutralizing with a zinc ion, manufactured by Du Pont Co., MI: 3.4, stiffness modulus: about 220 MPa ·X·16: Surlyn AD8512 (trade name)

Ethylene-methacrylic acid copolymer ionomer resin obtained by neutralizing with a sodium ion, manufactured by Du Pont Co., MI: 4.4, stiffness modulus: about 280 MPa ·X·17: TAFTEC Z514 (trade name)

Glycidyl methacrylate adduct of hydrogenated styrene-butadiene-styrene block copolymer, manufactured by Asahi Kasei Industries Co., Ltd., JIS-A hardness: 65, content of styrene: about 20% by weight, content of hydrogenated butadiene: about 80% by weight, content of glycidyl methacrylate: about 1% by weight ·X·18: AR-201 (trade name)

Product obtained by graft-modifying ethylene-ethyl acrylate copolymer with maleic anhydride, manufactured by Mitsui Du Pont Polychemical Co., Ltd., JIS-A hardness: 51

·X·19: Neucrel AN4212C (trade name)

Ethylene-isobutyl acrylate-methacrylic acid terpolymer resin [polymerization composition ratio: 76:20:4 (weight ratio)], manufactured by Mitusi Du Pont Polychemical Co., Ltd., MI: 12, Shore D-scale hardness: 30

·X·20: Bondine AX8390 (trade name)

Ethylene-ethyl acrylate-maleic anhydride terpolymer, manufactured by Sumitomo Chemical Industries Co., Ltd., MI: 7.0, Shore D-scale hardness: 14, content of ethyl acrylate+maleic anhydride: 32% (content of maleic anhydride: 1–4%)

·X·21: Hi-milan AM7316 (trade name)

Ethylene-butyl acrylate-methacrylic acid terpolymer ionomer resin, manufactured by Mitsui Du Pont Polychemical Co., Ltd., MI: 1.5, stiffness modulus: about 24 MPa (3) Production of golf ball A golf ball having an outer diameter of 42.7 mm was made by molding a semi-spherical half-shell from the cover composition of the above item (2), covering the thread wound core of the item (1) with two halfshells, followed by press molding in a mold for golf ball at 150° C. for 10 minutes and further painting.

The weight, compression, initial velocity and flight distance (carry) of the resulting golf ball were measured, and the durability, feeling (shot feel) and controllability were examined. The results are shown in Tables 6 to 8.

The compression was measured by PGA method, and the initial velocity was measured by R & A initial velocity measuring method. The flight distance was determined by mounting a No. 1 wood club to a swing robot manufactured by True Temper Co. and hitting the golf ball at a head speed of 45 m/second. The spin amount was determined by mounting a No. 9 iron club to the above swing robot manufactured by True Temper Co., hitting the golf ball at a head speed of 34 m/second and taking a photograph of a mark provided on the surface of the hit golf ball.

The durability was determined by mounting a No. 1 wood club to a swing robot manufactured by True Temper Co., hitting the golf ball at a head speed of 45 m/second to examine the number of hitting until breakage arises and indicating the resulting value as an index in case of the impact-resistant number (number of hitting until breakage arises) of Comparative Example 5 being 100.

The cut resistance was determined by mounting a pitching wedge to a swing robot manufactured by True Temper Co. and hitting the top part of the golf ball at a head speed of 30 m/second to examine whether a cut mark is formed or not. The evaluation results are represented according to the following evaluation criteria.

Evaluation criteria

○: No cut mark is formed.

Δ: A small cut mark is formed.

X: A large cut mark is formed.

XX: A large cut mark, which is scarcely fit for use, is formed.

The shot feel and the controllability of the resulting golf ball were evaluated by 10 top professional golfers according to a practical hitting test. When the feeling is evaluated, a No. 1 wood club was used. When the controllability is evaluated, a pitching sand wedge and a sand wedge were used. The evaluation criteria are as follows. The results shown in the Tables below are based on the fact that not less than 8 out of 10 professional golfers evaluated with the same criterion about each test item.

shot feel

○: Good, small impact force, light and soft feeling

Δ: Slightly inferior

X: Inferior, large impact force,

Controllability

○: Good, spin is easily put on a golf ball using an iron club, and the golf ball is easily stopped X: Inferior The physical properties of the golf balls of Examples 1 to 4, those of Examples 5 to 8 and those of Comparative Examples 1 to 5 are shown in Table 6, Table 7 and Table 8, respectively. These physical properties of the golf balls are obtained by examining golf balls which were allowed to stand for 3 months after production.

TABLE 6

| | Example No. | | | |
|---|---|---|---|---|
| | 1 | 2 | 3 | 4 |
| Ball physical properties | | | | |
| Weight (g) | 45.4 | 45.4 | 45.3 | 45.3 |
| Compression (PGA) | 84 | 87 | 85 | 85 |
| Initial velocity (feet/second) | 251.6 | 252.1 | 251.8 | 251.8 |
| Flight distance (yard) | 224 | 226 | 225 | 225 |
| Spin (rpm) | 8450 | 8350 | 8400 | 8400 |
| Cut resistance | ○ | ○ | ○ | ○ |
| Durability | 260 | 240 | 260 | 260 |
| Shot feel | ○ | ○ | ○ | ○ |
| Controllability | ○ | ○ | ○ | ○ |

TABLE 7

| | Example No. | | | |
|---|---|---|---|---|
| | 5 | 6 | 7 | 8 |
| Ball physical properties | | | | |
| Weight (g) | 45.4 | 45.4 | 45.3 | 45.3 |
| Compression (PGA) | 83 | 86 | 84 | 84 |
| Initial velocity (feet/second) | 251.4 | 251.9 | 251.6 | 251.8 |
| Flight distance (yard) | 224 | 226 | 225 | 225 |
| Spin (rpm) | 8550 | 8350 | 8500 | 8500 |
| Cut resistance | ○ | ○ | ○ | ○ |
| Durability | 300 | 250 | 275 | 280 |
| Shot feel | ○ | ○ | ○ | ○ |
| Controllability | ○ | ○ | ○ | ○ |

TABLE 8

| | Comparative Example No. | | | | |
|---|---|---|---|---|---|
| | 1 | 2 | 3 | 4 | 5 |
| Ball physical properties | | | | | |
| Weight (g) | 45.3 | 45.3 | 45.4 | 45.4 | 45.3 |
| Compression (PGA) | 95 | 81 | 67 | 95 | 85 |
| Initial velocity (feet/second) | 253.0 | 249.2 | 247.0 | 251.3 | 251.2 |
| Flight distance (yard) | 226 | 215 | 210 | 218 | 217 |
| Spin (rpm) | 5800 | 8450 | 10000 | 5600 | 8500 |
| Cut resistance | ○ | ○ | XX | ○ | XX |
| Durability | 150 | 260 | 85 | 150 | 100 |
| Shot feel | X | Δ | X | X | ○ |
| Controllability | X | ○ | ○ | X | ○ |

As is apparent from a comparison between physical properties of the golf balls of Examples 1 to 8 shown in Table 6 to 7 and those of Comparative Examples 1 to 5 shown in Table 8, the golf balls of Examples 1 to 8 attained the flight distance of 224–226 yards and showed almost the same flight distance as that of the golf ball of Comparative Example 1 used as a criterion for comparison with respect to the flight distance (i.e. golf ball using a general solid center as the center and using only a high-rigid ionomer resin as the resin component of the cover), and was superior in flight performance. The golf balls of Examples 1 to 8 showed a large amount of spin and had excellent feeling and controllability which are the same as those of the golf ball of Comparative Example 5 used as a criterion for comparison with respect to the flight distance (i.e. golf ball using a liquid center and a balata cover), and were superior in durability and cut resistance.

To the contrary, the golf ball of Comparative Example 1 using the center C (i.e. general solid center) and using only the high-rigid ionomer resin as the resin component of the cover attained large flight distance and was superior in flight performance, but was inferior in feeling and controllability.

Regarding the golf ball of Comparative Example 2 using the center D (i.e. center which is composed of the vulcanized article of the rubber composition containing the oily substance, but is not provided with the same coating layer of the oil-resistance substance as that of the present invention), the compression became lower than that of the golf ball of Comparative Example 1 because the oily substance bled). The ball initial velocity was also lowered and the flight distance became small and, further, the feeling was slightly inferior.

The golf ball of Comparative Example 3, wherein the stiffness modulus of the cover is too low even when using the center A (i.e. solid center obtained by providing the coating layer of the oil-resistant substance around the inner spherical rubber of the vulcanized article of the rubber composition containing the oily substance) similar to Examples 1 to 4, was inferior in initial velocity, flight performance, cut resistance and feeling. The golf ball of Comparative Example 4, wherein the stiffness modulus of the cover is slightly high even when using the center A similar to the above Examples, caused little spinning and was inferior in feeling and controllability.

What is claimed is:

1. A golf ball comprising a solid center, a thread rubber layer formed on the solid center and a cover formed on the thread rubber layer, wherein the solid center is composed of an inner spherical rubber formed of a vulcanized molded rubber composition containing an oily substance, and a coating layer of an oil-resistant substance around the inner spherical rubber so as to prevent the bleeding of the oily substance of the inner spherical rubber, and the cover contains an ionomer resin as a main component and a cover composition constituting the cover has a stiffness modulus of from 70 to 280 MPs.

2. The golf ball according to claim 1, wherein the ionomer resin is an ionomer resin obtained by neutralizing at least a portion of carboxyl groups in a copolymer of ethylene and acrylic acid or methacrylic acid with a metal ion, and/or an ionomer resin obtained by neutralizing at least a portion of carboxyl groups in a terpolymer of ethylene, acrylic acid or methacrylic acid and an α,β-unsaturated carboxylate with a metal ion.

3. The golf ball according to claim 2, wherein an amount of the α,β-unsaturated carboxylic acid of the ionomer resin is from 5 to 30% by weight.

4. The golf ball according to claim 1, wherein the cover composition has a Shore D-scale hardness of from 40 to 60.

5. The golf ball according to claim 1, wherein the resin component of the cover is a heated mixture of an ionomer resin and a glycidyl group-modified thermoplastic elastomer.

6. The golf ball according to claim 1, wherein the resin component of the cover is a heated mixture of an ionomer resin, a maleic anhydride-modified thermoplastic elastomer and a glycidyl group-modified thermoplastic elastomer.

7. The golf ball according to claim 1, wherein the resin component of the cover is a heated mixture of an ionomer resin and a terpolymer of ethylene, an unsaturated carboxylate and an unsaturated carboxylic acid.

* * * * *